US005930555A

United States Patent [19]

Lee

[11] Patent Number: 5,930,555

[45] Date of Patent: Jul. 27, 1999

[54] DEVELOPER LIQUID SUPPLY DEVICE OF WET TYPE ELECTROPHOTOGRAPHIC PRINTER

[75] Inventor: Hyong-gu Lee, Puchun, Rep. of Korea

[73] Assignee: Samsung Electronics Co., Ltd., Kyungki-do, Rep. of Korea

[21] Appl. No.: 09/124,765

[22] Filed: Jul. 30, 1998

[30] Foreign Application Priority Data

Dec. 12, 1997 [KR] Rep. of Korea ..... 97-68314

[51] Int. Cl.[6] ..... G03L 15/10

[52] U.S. Cl. ..... 399/57; 399/238

[58] Field of Search ..... 399/57, 233, 237, 399/238

[56] References Cited

U.S. PATENT DOCUMENTS 3,876,282 4/1975 Schon et al. ..... 399/238

5,461,466 10/1995 Girard et al. ..... 399/237

*Primary Examiner*—Joan Pendegrass

*Attorney, Agent, or Firm*—Sughrue, Mion, Zinn, Macpeak & Seas, PLLC

[57] ABSTRACT

A developer liquid supply device of a wet type electrophotographic printer, including: a reservoir, for storing developer liquid made by mixing a liquid carrier and ink, and for supplying the developer liquid to a developing unit through a developer liquid supply passage; a processing tank for storing developer liquid drained from the reservoir through a developer liquid drain passage; an ink cartridge installed inside the processing tank for supplying ink to the reservoir through an ink supply passage; and a carrier cartridge for supplying the liquid carrier to the reservoir through a carrier supply passage.

7 Claims, 2 Drawing Sheets

DEVELOPER LIQUID SUPPLY DEVICE OF WET TYPE ELECTROPHOTOGRAPHIC PRINTER

BACKGROUND OF THE INVENTION

1. Field of the Invention

The present invention relates to a wet type electrophotographic printer, and more particularly, to a developer liquid supply device of a wet type electrophotographic printer, in which the developer concentration and liquid level can be controlled.

2. Description of the Related Art

In general, a wet type electrophotographic printer prints a desired image by developing an electrostatic latent image formed on a photosensitive medium such as a photosensitive belt, with a predetermined color developer liquid, and transfers the developed image to a paper sheet. The wet type electrophotographic printer is provided with a developing unit, for supplying the developer liquid to the photosensitive medium, and a developer liquid supply device, for continuously supplying the developer liquid of a predetermined concentration to the developing unit. The developer liquid is a mixture of concentrated ink, containing a powder toner, and a liquid carrier. The concentration of the toner is about 2–4 wt %. Hereinafter, the concentration of the developer liquid is defined by the wt % of the toner.

The developer liquid supply device is provided with an ink cartridge for storing the concentrated ink, a carrier cartridge for storing the liquid carrier, and a reservoir for storing the developer liquid which is a mixture of the concentrated ink and the liquid carrier at a predetermined ratio. In addition, in the ink cartridge and the reservoir, agitators may be installed so the toner contained in the stored liquid does not precipitate.

In the developing device having the structure described above, since the developer liquid stored in the reservoir is decreased by the amount used in developing each electrostatic latent image of the photosensitive medium, the concentrated ink and the liquid carrier must be continually supplied to the reservoir in order to maintain the developer liquid at a constant concentration. In addition, it is necessary to maintain the level of the developer liquid stored in the reservoir at a specified height.

Further, the respective consumptions of the toner and the liquid carrier may vary with images to be printed. That is, when a simple image or a small image is printed, more liquid carrier is consumed than toner, and when a complicated image is printed, relatively more toner is consumed than liquid carrier. Therefore, in order to maintain the predetermined concentration of the developer liquid, it is necessary to appropriately supply the toner and the developer liquid to the reservoir in accordance with the respective consumptions of the toner and the liquid carrier.

However, with the above developer liquid supply device, the concentration and level of the developer liquid cannot be successfully adjusted at the same time. That is, when a large amount of the liquid carrier is supplied to the reservoir in order to maintain the constant concentration of the developer liquid in the reservoir, the level of the developer liquid may become inappropriate for printing, or when the level of the developer liquid is adjusted, the correct concentration of the developer liquid may be lost.

SUMMARY OF THE INVENTION

To solve the above problems, it is an objective of the present invention to provide a developer liquid supply device of a wet type electrophotographic printer having an improved structure to appropriately adjust both the concentration and level of a developer liquid.

It is another objective of the present invention to provide a developer liquid supply device capable of reducing the installation space of components and utilizing the increased space.

Accordingly, to achieve the above objective, there is provided a developer liquid supply device of a wet type electrophotographic printer, including: a reservoir, for storing developer liquid made by mixing a liquid carrier and ink, and for supplying the developer liquid to a developing unit through a developer liquid supply passage; a processing tank for storing developer liquid drained from the reservoir through a developer liquid drain passage; an ink cartridge installed inside the processing tank for supplying the ink to the reservoir through an ink supply passage; and a carrier cartridge for supplying the liquid carrier to the reservoir through a carrier supply passage.

In addition, in the device, it is preferable that the ink cartridge is contractible. For this, folds may be formed in the side walls of the ink cartridge.

According to another embodiment of the present invention, the device further includes: a concentration sensor for sensing the concentration of the developer liquid in the reservoir; wherein when the concentration of the developer liquid, sensed by the concentration sensor, is not a predetermined concentration, the developer liquid in the reservoir is drained to the processing tank.

Further, the device further includes: a valve for selectively opening and closing the developer liquid drain passage and the developer liquid supply passage; and a concentration sensor for sensing the concentration of the developer liquid in the reservoir, wherein when the concentration of the developer liquid, sensed by the concentration sensor, is not a predetermined concentration, the developer liquid supply passage is closed and the developer liquid drain passage is opened by the valve.

According to another aspect of the present invention, the device further includes a recycle passage for supplying the developer liquid from the processing tank to the reservoir.

Furthermore, the device further includes: a valve for selectively opening and closing the ink supply passage, the carrier supply passage and the recycle passage; and a concentration sensor for sensing the concentration of the developer liquid in the reservoir, wherein the value selectively opens and closes the ink supply passage, the carrier supply passage and the recycle passage in order to control the amounts of ink, liquid carrier and developer liquid supplied to the reservoir.

BRIEF DESCRIPTION OF THE DRAWINGS

The above objectives and advantages of the present invention will become more apparent by describing in detail a preferred embodiment thereof with reference to the attached drawings in which.

DESCRIPTION OF THE PREFERRED EMBODIMENTS

Figure 1:
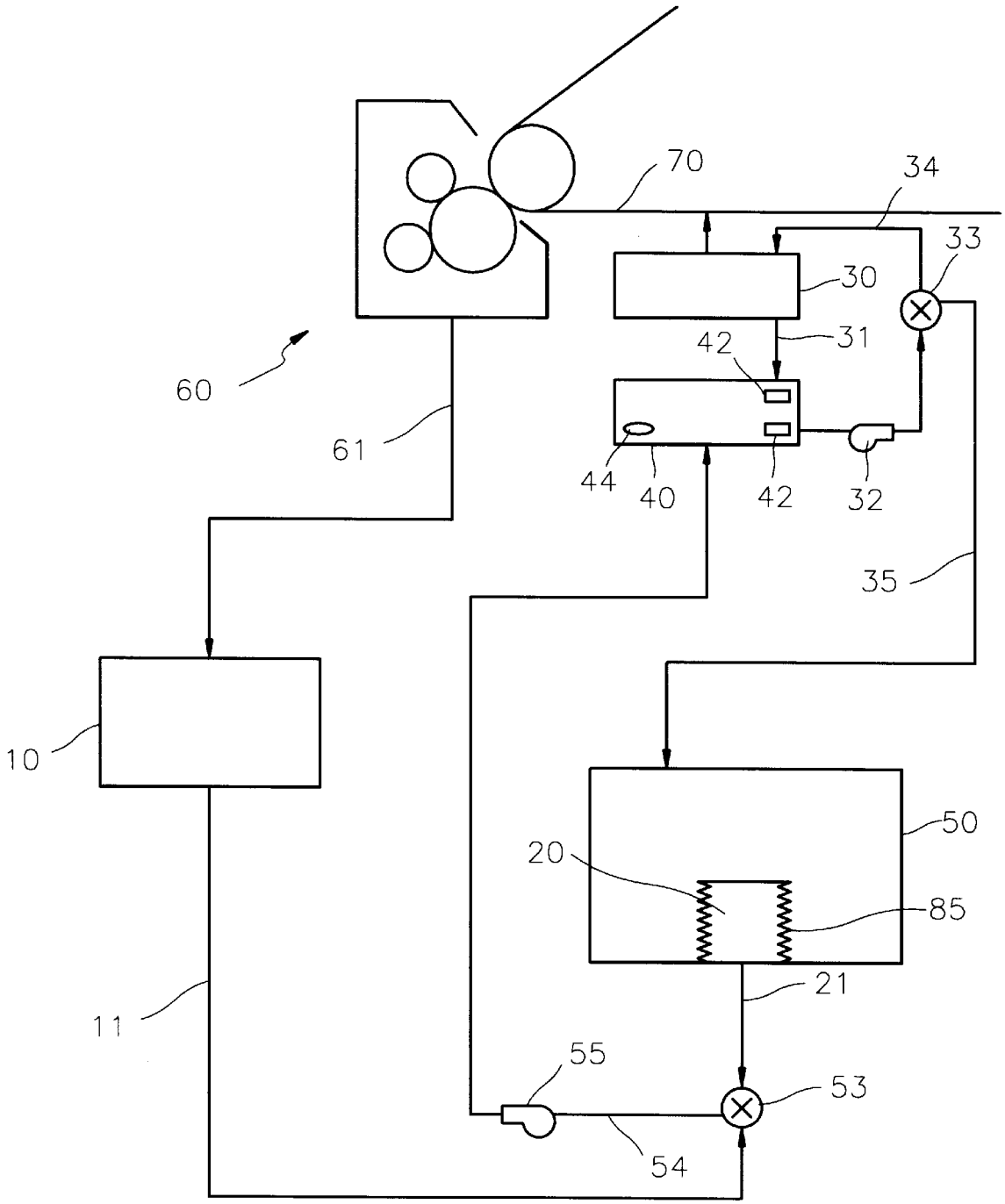
FIG. 1 is a schematic diagram illustrating a developer liquid supply device of a wet type electrophotographic printer according to an embodiment of the present invention.

FIG. 1 shows a developer liquid supply device of a wet type electrophotographic printer according to an embodiment of the present invention.

Referring to FIG. 1, a liquid carrier is stored in a carrier cartridge 10, and concentrated ink is stored in an ink cartridge 20. The carrier cartridge 10 and the ink cartridge 20 are replaceable with new cartridges when exhausted. The carrier cartridge 10 and the ink cartridge 20 communicate with a first valve 53 such as a solenoid two-way valve via a carrier supply passage 11 and an ink supply passage 21, respectively. The first valve 53 supplies the ink and the liquid carrier by the driving force of a first pump 55 to a reservoir 40 via an ink/carrier supply passage 54, by selectively opening and closing the carrier supply passage 11 and the ink supply passage 21.

A level sensor 42 and a concentration sensor 44, which respectively sense the level and concentration of the developer liquid, are installed in the reservoir 40. In addition, the reservoir 40 supplies the developer liquid composed of the ink and the liquid carrier to a developing unit 30 via a developer liquid supply passage 34, by the driving force of a second pump 32. The developing unit 30 develops an electrostatic latent image formed on a photosensitive belt 70 with the developer liquid supplied from the reservoir 40.

A second valve 33 such as a solenoid two-way valve is installed in the middle of the developer liquid supply passage 34. The second valve 33 selectively opens and closes the developer liquid supply passage 34 and a developer liquid drain passage 35 to direct the developer liquid from the reservoir 40 to the developing unit 30 or a processing tank 50, via the developer liquid supply passage 34 or the developer liquid drain passage 35, respectively.

In FIG. 1, reference numeral 60 denotes a drying portion for recovering the liquid carrier adhering to the electrostatic latent image of the photosensitive belt 70. The recovered liquid carrier returns to the carrier cartridge 10 through a recovery tube 61.

According to the present invention, the ink cartridge 20 is installed inside the processing tank 50. Since the ink cartridge 20 is formed in the shape of a bellows by making folds 85 in the side walls of the ink cartridge 20, the volume of the ink cartridge 20 can be changed. That is, the ink cartridge 20 is contracted by the internal vacuum created when the ink is pumped out from the ink cartridge 20, or by the pressure of the developer liquid pumped in the processing tank 50. The ink cartridge 20 is not limited to this example, and any contractible container can be employed such as a flexible bag which can be contracted when the ink is pumped out.

Now, the operation of the developer liquid supply device according to the present embodiment which has the above structure, will be described.

When the power is turned on to operate the printer, the first valve 53 selectively opens the ink supply passage 21 and the carrier supply passage 11 to supply the ink and the liquid carrier from the ink cartridge 20 and the carrier cartridge 10 to the reservoir 40. The supplied ink and liquid carrier are mixed with each other to give the developer liquid a predetermined concentration and a desired liquid level.

At this time, as the ink in the ink cartridge 20 is pumped out, the ink cartridge 20 contracts, and therefore, the vacant space in the processing tank 50 increases in proportion to the contracted volume of the ink cartridge.

Then, the developer liquid in the reservoir 40 is supplied to the developing unit through the developer liquid supply passage 34 by the driving force of the second pump 32. At this time, the developer liquid drain passage 35 remains closed by the second valve 33. Therefore, the electrostatic latent image formed on the photosensitive belt 70 is developed with the supplied developer liquid. At this time, the excess developer liquid supplied to the photosensitive belt 70 is removed by a recovery means such as a squeegee roller (not shown), and is returned to the reservoir 40 through a passage 31.

During the printing operation, as the respective consumptions of the ink and the carrier differ from standard values according to the above-mentioned printing job conditions, the concentration of the developer liquid recovered through the passage 31 differs from that of the developer liquid supplied through the developer liquid supply passage 34. Consequently, the concentration of the developer liquid in the reservoir 40 is changed. In such a situation, the concentration sensor 44 senses the abnormal concentration of the developer liquid, and sends a signal to a controller (not shown). The controller stops the printing operation in response to the signal, and operates the second valve 33 to shut off the developer liquid supply passage 34 and open the developer liquid drain passage 35. Accordingly, the developer liquid in the reservoir 40 is drained to the processing tank 50 by the driving force of the second pump 32. The developer liquid in the reservoir 40 is drained to the processing tank 50 to make space in the reservoir 40 into which new ink and carrier liquid are supplied. At this time, the drained amount of the developer liquid can be adjusted appropriately.

Then, the first valve 53 is operated to supply the ink and the liquid carrier to the reservoir 40, and the developer liquid of a proper concentration is mixed.

According to the present invention, since a portion of the developer liquid in the reservoir 40 is drained to the processing tank 50, the concentration and level of the developer liquid is easily controlled.

Further, during the printing operation, when the ink in the ink cartridge 20 is discharged, the volume of the ink cartridge 20 is decreased, and when the developer liquid enters the processing tank 50, the vacant space of the processing tank 50 is decreased. Taking this into consideration, the contractible ink cartridge is installed in the processing tank 50, so the vacant space formed in accordance with the contraction of the ink cartridge 20 can be utilized. Therefore, the efficiency of space utilization is high, and the volume of the whole device is decreased. Here, the capacity of the processing tank 50 is decided in consideration of the amount of the developer liquid supplied from the reservoir 40 and the amount of the ink discharged from the ink cartridge.

Figure 2:
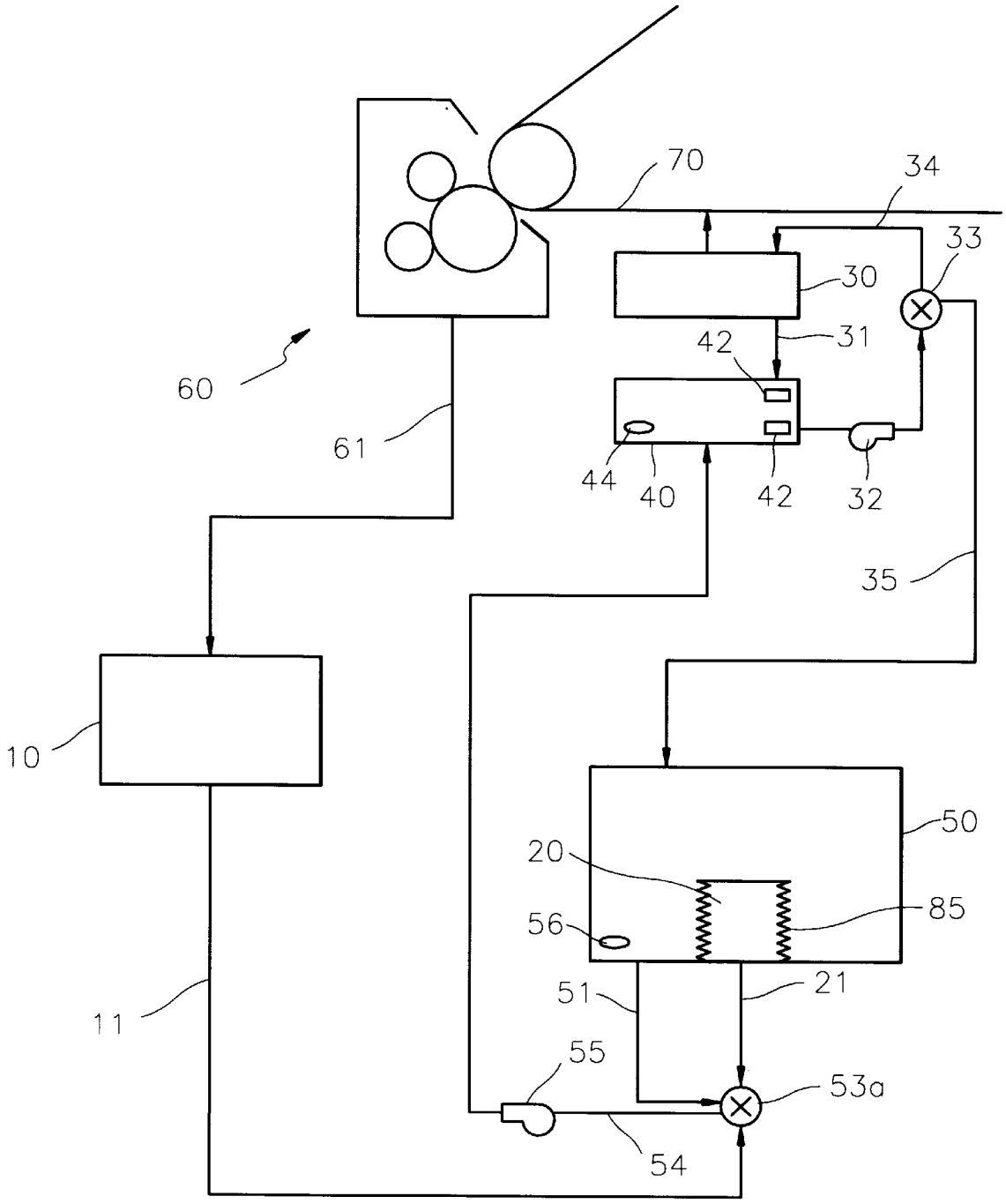
FIG. 2 is a schematic diagram illustrating a developer liquid supply device of a wet type electrophotographic printer according to another embodiment of the present invention.

FIG. 2 shows the structure of another embodiment of a developer liquid supply device according to the present invention. The same reference numerals denote similar members of the same function to those of FIG. 1.

According to the present embodiment, a processing tank 50 is connected to a third valve 53*a* such as a solenoid three-way valve by a recycle passage 51. Therefore, the developer liquid in the processing tank 50 can be supplied to the reservoir 40 via the recycle passage 51 and the third valve 53*a,* and can be reused.

A concentration sensor 56 is installed in the processing tank 50, and senses the concentration of the developer liquid in the processing tank 50 in order to decide the amount of the developer liquid to be supplied to the reservoir 40.

In the operation of the developer liquid supply device according to the present embodiment, when a predetermined amount of developer liquid is discharged from the reservoir 40 and stored in the processing tank 50, the concentration of the developer liquid is measured by the concentration sensor 56, and the concentration information signal is sent to a controller (not shown).

Then, the controller drives the third valve 53*a,* and selectively opens a carrier supply passage 11, an ink supply passage 21 and the recycle passage 51 to supply the developer liquid from the processing tank 50, as well as the liquid carrier and the ink, to the reservoir 40. In this case, the controller controls the supplied amount of ink and liquid carrier according to the transferred concentration information of the developer liquid in order to maintain the proper concentration and liquid level of the resulting developer liquid in the reservoir 40.

In the present embodiment, the developer liquid in the processing tank 50 can be supplied to the reservoir 40 and can be reused. At this time, the vacant space created in the processing tank 50 is equal to the sum of the vacant space due to the discharge of the developer liquid and the vacant space due to the contraction of the ink cartridge 20.

With the present invention as described above, the provision of a separate processing tank makes it possible to drain the developer liquid from a reservoir to the processing tank, and therefore facilitates the control of the concentration and level of the developer liquid in the reservoir. Further, the developer liquid in the processing tank can be reused without any undesirable concentration deviation of the developer liquid. Furthermore, the ink cartridge is installed in the processing tank, and therefore the efficiency of space utilization is high, and the volume of the whole device can be decreased.

In this specification, a developer liquid supply device for one developing unit is disclosed. However, the same developer liquid supply device can be applied to a printer having a plurality of developing units corresponding to colors of yellow, magenta, cyan, black, etc.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A developer liquid supply device of a wet type electrophotographic printer, comprising:

a reservoir, for storing developer liquid comprising a mixture of a liquid carrier and an ink, and for supplying the developer liquid to a developing unit through a developer liquid supply passage;

a processing tank for storing developer liquid drained from the reservoir through a developer liquid drain passage;

an ink cartridge installed inside the processing tank for supplying the ink to the reservoir through an ink supply passage; and a carrier cartridge for supplying the liquid carrier to the reservoir through a carrier supply passage.

2. The developer liquid supply device of a wet type electrophotographic printer as claimed in claim 1, wherein the ink cartridge is contractible.

3. The developer liquid supply device of a wet type electrophotographic printer as claimed in claim 2, wherein folds are formed in side walls of the ink cartridge.

4. The developer liquid supply device of a wet type electrophotographic printer as claimed in claim 2, further comprising:

a concentration sensor for sensing a concentration of the developer liquid in the reservoir;

wherein when the concentration of the developer liquid, sensed by the concentration sensor, is not a predetermined concentration, the developer liquid in the reservoir is drained to the processing tank.

5. The developer liquid supply device of a wet type electrophotographic printer as claimed in claim 2, further comprising:

a valve for selectively opening and closing the developer liquid drain passage and the developer liquid supply passage; and a concentration sensor for sensing a concentration of the developer liquid in the reservoir, wherein when the concentration of the developer liquid, sensed by the concentration sensor, is not a predetermined concentration, the developer liquid supply passage is closed and the developer liquid drain passage is opened by the valve.

6. The developer liquid supply device of a wet type electrophotographic printer as claimed in claim 2, further comprising a recycle passage for supplying the developer liquid from the processing tank to the reservoir.

7. The developer liquid supply device of a wet type electrophotographic printer as claimed in claim 6, further comprising:

a valve for selectively opening and closing the ink supply passage, the carrier supply passage and the recycle passage; and a concentration sensor for sensing a concentration of the developer liquid in the reservoir, wherein the value selectively opens and closes the ink supply passage, the carrier supply passage and the recycle passage in order to control the amounts of ink, liquid carrier and developer liquid supplied to the reservoir.

* * * * *